United States Patent [19]

Nakada

[11] 4,043,263

[45] Aug. 23, 1977

[54] PRINTING MACHINE WITH VERTICALLY SHIFTABLE CREDIT CARD SUPPORTING PLATE

[75] Inventor: Tetsuo Nakada, Sagamihara, Japan

[73] Assignee: Janome Sewing Machine Co., Tokyo, Japan

[21] Appl. No.: 439,759

[22] Filed: Feb. 5, 1974

[30] Foreign Application Priority Data

Feb. 9, 1973 Japan ..... 48-16648

[51] Int. Cl.[2] ..... B41F 3/04

[52] U.S. Cl. ..... 101/45; 101/269

[58] Field of Search ..... 101/56, 45, 269–274, 101/407 BP

[56] References Cited

U.S. PATENT DOCUMENTS

| | | | |
|---|---|---|---|
| 3,090,303 | 5/1963 | Manners et al. | 101/269 |
| 3,388,659 | 6/1968 | Hu | 101/269 |
| 3,780,669 | 12/1973 | Geiger et al. | 101/269 |
| 3,795,191 | 3/1974 | Miller et al. | 101/269 |
| 3,800,700 | 4/1974 | McInnis et al. | 101/269 |
| 3,818,829 | 6/1974 | Patterson | 101/269 |

*Primary Examiner*—Edward M. Coven
*Attorney, Agent, or Firm*—Michael J. Striker

[57] ABSTRACT

A printing machine in which a series of selectively settable type wheels arranged in the housing of the machine extend with portions thereof through openings in a printing bed fixedly mounted on the machine housing. A credit card supporting plate is mounted on the printing bed adjustable relative thereto and a curved leaf spring, substantially of the same outline as the credit card supporting plate, is placed between the latter and the printing bed to bias the credit card supporting plate in a direction away from the upper surface of the printing bed. A carriage, rotatably carrying a platen roller, is mounted on the printing bed movable across the latter so that a credit card supported on the credit card supporting plate and types on the type wheels may be printed on a sheet placed over the credit card and the type wheels. Due to the adjustable mounting of the credit card supporting plate on the printing bed a proper printing of the types will be assured regardless of the thickness of the credit card placed on the credit card supporting plate.

5 Claims, 3 Drawing Figures

PRINTING MACHINE WITH VERTICALLY SHIFTABLE CREDIT CARD SUPPORTING PLATE

BACKGROUND OF THE INVENTION

The present invention relates to a printing machine which has a plurality of selectively settable type wheels protruding in part through openings in a printing bed of the machine and a credit card supporting plate on the printing bed for supporting a credit card so that types on the type wheels and on the credit card may be transferred on a sheet when a carriage rotatably carrying a platen roller moves in transverse direction over the printing bed.

The printing bed usually carries also a dealer's name plate provided with indicia so that the dealer's name may be printed together with the types on the type wheels in one operation. The type wheels and the dealer's nameplate are arranged during assembly of the machine with great precision to assure that the indicia on the dealer's nameplate and the uppermost indicia on the type wheels are located in one plate. However, the credit cards, which are usually made of plastic, are produced by various credit firms and, therefore, these credit cards may have a different thickness. Such difference in thickness of the credit card may lead to considerable trouble if the credit card is supported on a credit card supporting plate which is fixedly mounted on the printing bed since, due to the different thicknesses of the credit cards, a proper printing of information on the latter together with a proper printing of the indicia on the type wheels and the indicia on the dealer's nameplate may in this case not be assured.

SUMMARY OF THE INVENTION

It is an object of the present invention to overcome the above pointed out difficulties in printing machines of the aforementioned type.

It is a further object of the present invention to provide a printing machine of the aforementioned kind in which proper printing of the indicia on a credit card may be assured together with proper printing of indicia on a dealer's nameplate and settable type wheels, regardless of the thickness of the credit card used.

It is an additional object of the present invention to provide a printing machine of the aforementioned kind which is composed of relatively few and simple parts so that the machine may be built at reasonable cost and stand up properly under extended use.

With these and other objects in view, which will become apparent as the description proceeds, the printing machine according to the present invention mainly comprises a printing bed, a plurality of selectively settable type wheels projecting in part beyond the upper surface of the printing bed, a credit card supporting plate having an upper face for supporting a selected one of a plurality of credit cards thereon, a carriage movable across the printing bed and rotatably carrying a platen roller, and means mounting the credit card supporting plate on the printing bed adjustable in vertical direction relative thereto during a printing operation so that information on a credit card supported on said plate may be properly printed together with types on the type wheels, regardless of the thickness of the credit card used.

The mounting means for the credit card supporting plate preferably comprises resilient means between the printing bed and the credit card supporting plate and such resilient means may be in the form of a curved leaf spring which has substantially the same outline as the credit card supporting plate.

The mounting means preferably further comprise means for guiding the credit card supporting plate movable in vertical direction relative to the printing bed and means for limiting movement of the credit card supporting plate in said vertical direction away from the printing bed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
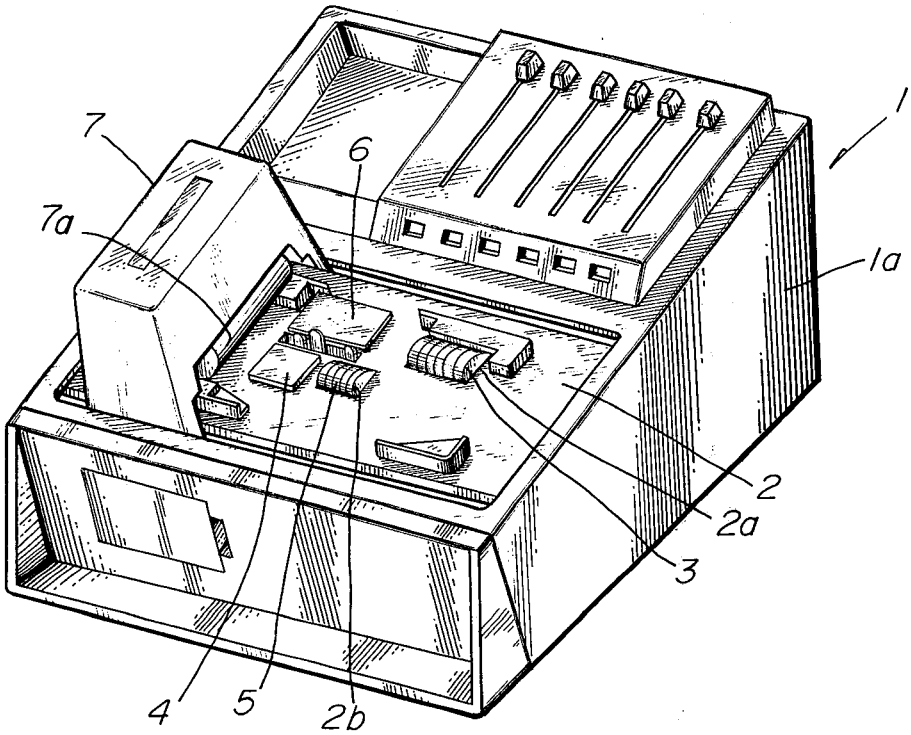
FIG. 1 is a perspective view of a printing machine according to the present invention.

Referring now to the drawing, and more specifically to FIG. 1 of the same, it will be seen that the printing machine 1 according to the present invention includes a machine housing 1*a* to which a printing bed 2 is fixedly attached in the region of the top of the housing. A series of selectively settable type wheels 3 are turnably mounted in a known manner in the machine housing and portions of these type wheels 3 project beyond the upper face of the printing bed 2 through an opening 2*a* in the printing bed. A plurality of selectively settable data wheels 5 are likewise turnably mounted in the machine housing and project with portions thereof through an opening 2*b* in the printing bed 2 beyond the upper surface of the latter. A dealer's nameplate 4 is also mounted on the printing bed 2. The type wheels 3 and the data wheels 5 may be selectively turned by means well known in the art and not forming part of the present invention. A credit card supporting plate 6 is adjustably arranged on the printing bed 2 adjacent the dealer's nameplate 4, for supporting on the upper surface thereof a selected one of a plurality of credit cards. A carriage 7 is mounted on the printing bed movable across the same from a rest position, as shown in FIG. 1, to a position at the other side of the printing bed 2 and the carriage 7 rotatably carries a platen roller 7*a*. The platen roller 7*a* is adapted to press a slip or sheet of paper properly positioned in place on the printing bed 2 to print indicia on the type wheels 3, the data wheels 5, on the dealer's nameplate 4 and on a credit card supported on the credit card supporting plate 6 during movement of the carriage 7 from its rest position toward the right, as viewed in FIG. 1.

During the assembly of the machine the position of the type wheels 3, the data wheels 5 and the dealer's nameplate 4 is exactly adjusted so that the uppermost indicia on the type wheels 3 and the data wheels 5 together with indicia on the dealer's nameplate 4 are exactly in one plane parallel to the upper face of the printing bed.

According to the present invention, the credit card supporting plate 6 is vertically adjustable with respect to the upper face of the printing bed 2 so that indicia on a credit card placed on the credit card supporting plate 6 may be brought in alignment with the aforementioned plane.

Figure 3:
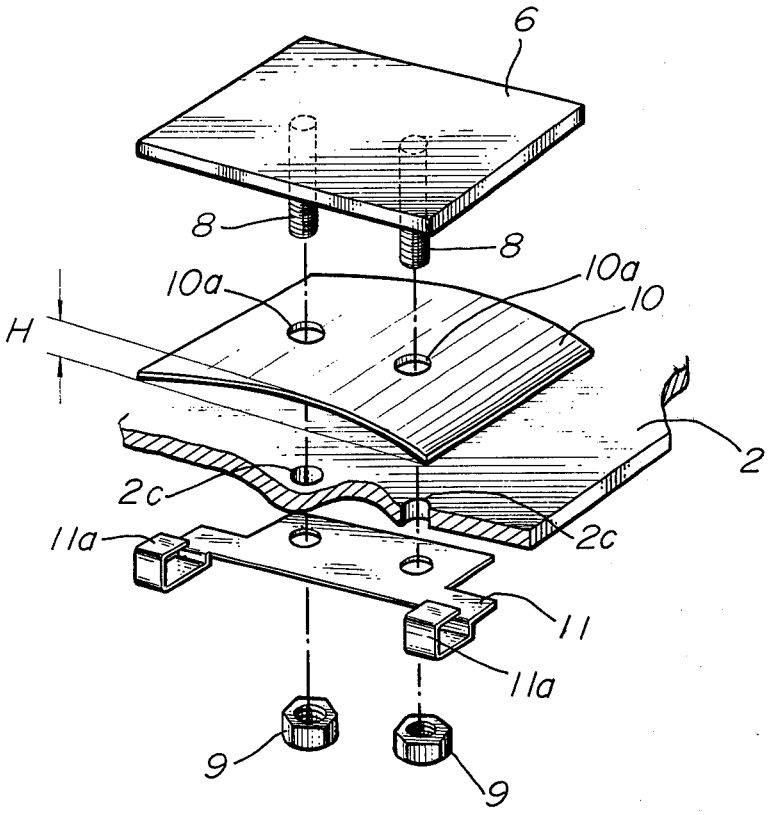
FIG. 3 is an exploded perspective view of the credit card supporting plate and associated parts.

Such vertical adjustment of the credit card supporting plate 6 is accomplished by a curved leaf spring 10 of substantially the same outline as the credit card supporting plate 6, and sandwiched between the bottom face of the latter and the top face of the printing bed 2. The credit card supporting plate 6 is further provided with a pair of parallel bolts 8 fixed in any convenient manner thereto and projecting spaced from each other and substantially normal to the credit card supporting plate 6 from the bottom face of the latter through openings 10*a* in the leaf spring and aligned openings 2*c* in the printing bed 2. The bolts 8 carry in the region of the lower ends thereof nuts 9 screwed thereon and by adjustment of the position of the nuts 9 on the bolts 8 the maximum movement of the credit card supporting plate 6 in the direction away from the upper face of the printing bed 2 under the influence of the curved leaf spring 10 may be adjusted. The leaf spring 10 has an upper convex surface and a curvature H as indicated in FIG. 3.

Figure 2:
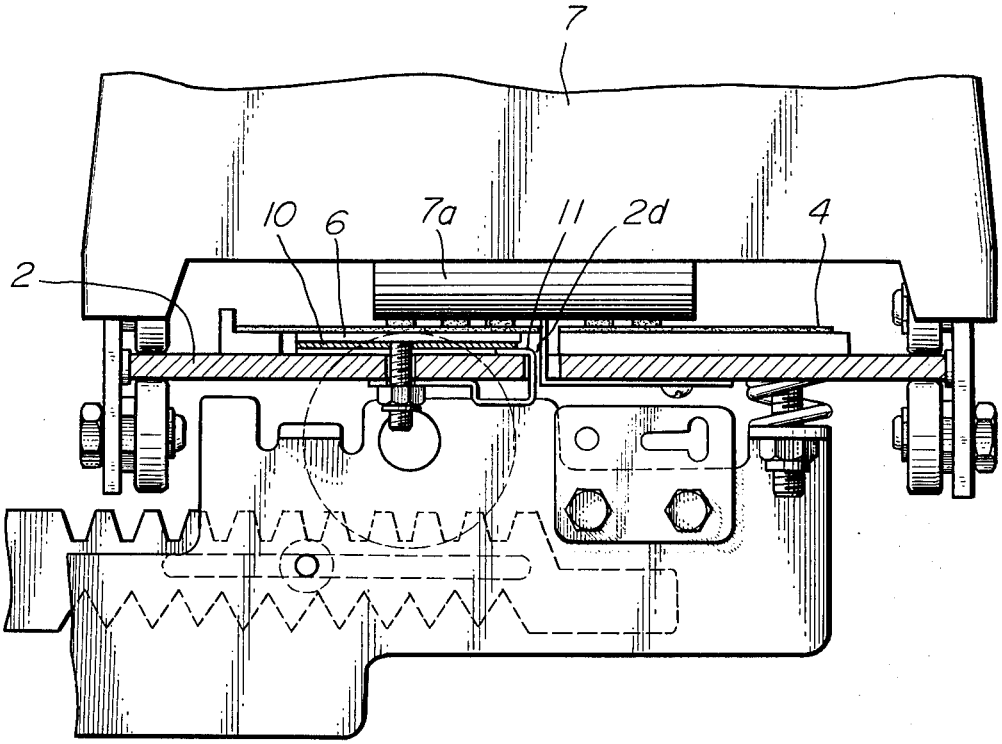
FIG. 2 is a transverse cross section through the printing bed and the credit card supporting plate together with associated parts of the printing machine.

An auxiliary support plate 11 of resiliently flexible material, for instance spring steel, may also be provided engaging with a portion thereof the bottom face of the printing bed 2, as best shown in FIG. 2, and this auxiliary support plate 11 may also be provided with openings through which the bolts 8 extend. The auxiliary support plate 11 has at one side thereof a pair of spaced substantially U-shaped portions 11*a* which are offset from the top face of the auxiliary support plate 11 and which respectively extend through openings 2*d* formed in the printing bed 2, as shown in FIG. 2, to engage with free end portions thereof one side of the leaf spring 10 which is located in the region of a central portion of the printing bed 2. The purpose of this auxiliary supporting plate 11 is to compensate any bending of the central portion of the printing bed 2 during passage of the platen roller 7*a* over the central portion and to maintain, despite such small bending of the central portion of the printing bed 2 during the printing operation, the upper face of the credit card supporting plate 6 parallel to the aforementioned plane.

The nuts 9 on the bolts 8 are adjusted during assembly of the various parts of the printing machine in such a manner that the upper type face of the thinnest credit card in use, when placed on the credit card supporting plate 6 will be at the same level with the uppermost type face on the type wheels 3 and the data wheels 5 as well as with the type face on the dealer's nameplate 4. If now a credit card thicker then the thinnest credit card in use is placed on the credit card supporting plate 6, the credit card supporting plate 6 may yield against the pressure of the leaf spring 10 during the printing operation so that proper printing of indicia on the upper face of the credit card together with the indicia on the type wheels 3, the data wheels 5 and on the dealer's nameplate 4 will be assured.

It will be understood that each of the elements described above, or two or more together, may also find a useful application in other types of printing machines with vertically shiftable credit card support plates differing from the type described above.

While the invention has been illustrated and described as embodied in a printing machine with a credit card supporting plate which is vertically shiftable against the bias of a spring, it is not intended to be limited to the details shown, since various modifications and structural changes may be made without departing in any way from the spirit of the present invention.

Without further analysis, the foregong will so fully reveal the gist of the presen invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A printing machine comprising a printing bed having an upper face and a bottom face; a plurality of selectively settable type wheels projecting in part beyond said upper face of said printing bed; a flat credit card supporting plate having an upper face for supporting a selected one of a plurality of credit cards thereon; a carriage mounted on and movable across said printing bed; a platen roller rotatably carried by said carriage; and means mounting said credit card supporting plate on said printing bed adjustable in vertical direction relative to the latter during a printing operation so that information on the credit card supported on said credit card supporting plate may be properly printed together with types on said type wheels, regardless of the thickness of the credit card used, said mounting means comprising a curved leaf spring substantially of the same outline as said credit card supporting plate and located between said printing bed and said credit card supporting plate.

2. A printing machine as defined in claim 1, wherein said mounting means further comprise means for guiding said credit card supporting plate movable in vertical direction relative to said printing bed, and means for limiting movement of said credit card supporting plate in said vertical direction away from said printing bed.

3. A printing machine as defined in claim 2, wherein said printing bed is provided with a plurality of openings, wherein said guide means comprise a plurality of bolts each fixed at one end to said credit card supporting plate and projecting therefrom substantially normal thereto through said openings in said printing bed, and wherein said limiting means comprises a plurality of nuts respectively adjustably connected to the other end of each of said bolts.

4. A printing machine as defined in claim 1, wherein said printing bed is provided with two openings spaced from each other in the direction of movement of the carriage, and wherein said curved leaf spring is formed with openings substantially aligned with said openings in said printing bed, a pair of threaded bolts each fixed at one end to said credit card supporting plate and projecting therefrom substantially normal thereto through the respective openings in said leaf spring and said printing bed, and a pair of nuts respectively screwed on said bolts and engaging the bottom face of said printing bed so that, by tightening said nuts, the vertical distance of said credit card supporting plate from said upper face of said printing bed may be adjusted while said credit card supporting plate will be yieldably supported over a major portion in the central region thereof by said leaf spring.

5. A printing machine as defined in claim 1, wherein said carriage is mounted on said printing bed by at least two pairs of rollers, the rollers in each pair respectively engage said upper and said bottom face of said printing bed.

* * * * *